US010607628B2

(12) United States Patent
Nakayama et al.

(10) Patent No.: US 10,607,628 B2
(45) Date of Patent: Mar. 31, 2020

(54) AUDIO PROCESSING METHOD, AUDIO PROCESSING DEVICE, AND COMPUTER READABLE STORAGE MEDIUM

(71) Applicant: FUJITSU LIMITED, Kawasaki-shi, Kanagawa (JP)

(72) Inventors: Sayuri Nakayama, Kawasaki (JP); Taro Togawa, Kawasaki (JP); Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 40 days.

(21) Appl. No.: 15/687,748

(22) Filed: Aug. 28, 2017

(65) Prior Publication Data

US 2018/0061436 A1 Mar. 1, 2018

(30) Foreign Application Priority Data

Aug. 30, 2016 (JP) ..... 2016-168628

(51) Int. Cl.
*G10L 21/0208* (2013.01)
*G10L 21/0232* (2013.01)
(Continued)

(52) U.S. Cl.
CPC ..... *G10L 21/0324* (2013.01); *G10L 21/0208* (2013.01); *G10L 25/18* (2013.01); *G10L 25/51* (2013.01); *G10L 21/0232* (2013.01)

(58) Field of Classification Search
CPC . G10L 21/0324; G10L 21/0208; G10L 25/18; G10L 25/51; G10L 21/0232; H04R 3/005
(Continued)

(56) References Cited

U.S. PATENT DOCUMENTS 6,301,357 B1 * 10/2001 Romesburg ..... H04M 9/08 379/406.01
2008/0010063 A1 1/2008 Komamura
(Continued)

FOREIGN PATENT DOCUMENTS

| | | |
|---|---|---|
| EP | 2 916 322 A1 | 9/2015 |
| JP | 2008-295011 | 12/2008 |
| JP | 2009-20471 | 1/2009 |

OTHER PUBLICATIONS

Extended European Search Report dated Dec. 11, 2017 in Patent Application No. 17188203.8, citing documents AA-AB and AO therein, 9 pages.

*Primary Examiner* — Vivian C Chin
*Assistant Examiner* — Con P Tran
(74) *Attorney, Agent, or Firm* — Xsensus LLP

(57) ABSTRACT

An audio processing method including: generating a plurality of frequency spectra by transforming a plurality of audio signals inputted to a plurality of input devices respectively, comparing an amplitude of each of frequency components of a specific frequency spectrum included in the plurality of frequency spectra with an amplitude of each of frequency components of one or a more other frequency spectra different from the specific frequency spectrum included in the plurality of frequency spectra, for each of the frequency components, extracting, from the frequency components, a frequency component in which an amplitude of the specific frequency spectrum is larger than an amplitude of the one or more other frequency spectra, and controlling an output corresponding to the plurality of audio signal inputted to each of the plurality of input devices based on a proportion of the extracted frequency component in the frequency components whose amplitudes has been compared.

10 Claims, 10 Drawing Sheets

(51) Int. Cl.
*G10L 21/0324* (2013.01)
*G10L 25/18* (2013.01)
*G10L 25/51* (2013.01)

(58) Field of Classification Search
USPC ..... 381/94.2, 94.3, 94.1, 56, 94.7, 71.1, 381/71.12; 708/403, 404, 405; 700/94
See application file for complete search history.

(56) References Cited

U.S. PATENT DOCUMENTS

2008/0085012 A1* 4/2008 Matsuo ..... G10L 21/0208 381/94.3
2009/0323977 A1* 12/2009 Kobayashi ..... H04R 1/406 381/71.8
2011/0019832 A1* 1/2011 Itou ..... H04M 9/082 381/66
2015/0248895 A1 9/2015 Matsumoto

* cited by examiner

AUDIO PROCESSING METHOD, AUDIO PROCESSING DEVICE, AND COMPUTER READABLE STORAGE MEDIUM

CROSS-REFERENCE TO RELATED APPLICATION

This application is based upon and claims the benefit of priority of the prior Japanese Patent Application No. 2016-168628, filed on Aug. 30, 2016, the entire contents of which are incorporated herein by reference.

FIELD

The embodiments discussed herein are related to an audio processing program, an audio processing method, and an audio processing device.

BACKGROUND

With increasing demands for audio recognition and an audio analysis, a technology for accurately analyzing audio generated by a speaker is desired. A method of the technology of the audio analysis is binary masking. In the binary masking, a frequency analysis is performed for each piece of audio obtained by a plurality of input devices, an input of a desired sound having a large signal level and an input of an undesired sound having a small signal level (noise or the like other than the desired sound) are specified by comparing magnitude of a signal level for each of frequency components, and an analysis of the desired sound is performed by removing the undesired sound.

Japanese Laid-open Patent Publication No. 2009-20471 is an example of the related art.

SUMMARY

According to an aspect of the invention, the audio processing method includes generating a plurality of frequency spectra by transforming a plurality of audio signals inputted to a plurality of input devices respectively, comparing an amplitude of each of frequency components of a specific frequency spectrum included in the plurality of frequency spectra with an amplitude of each of frequency components of one or a more other frequency spectra different from the specific frequency spectrum included in the plurality of frequency spectra, for each of the frequency components, extracting, from the frequency components, a frequency component in which an amplitude of the specific frequency spectrum is larger than an amplitude of the one or more other frequency spectra, and controlling an output corresponding to the plurality of audio signal inputted to each of the plurality of input devices based on a proportion of the extracted frequency component in the frequency components whose amplitudes has been compared.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

However, a change in a surrounding environment causes a change in a frequency spectrum of audio, so that there is a case where magnitude of a desired sound and magnitude of an undesired sound may be reversed and separation accuracy between the desired sound and the undesired sound may decrease. As a result, an error occurs in an audio analysis.

As one aspect, an object of the present embodiment is to improve accuracy of the audio analysis.

Hereinafter, an audio processing device 100 according to a first embodiment will be described with reference to drawings.

The audio processing device 100 analyzes frequencies of audio signals received from a plurality of input devices and generates a plurality of frequency spectra. The audio processing device 100 compares signal levels of frequency spectra with the same frequencies with other frequency spectra for each of the frequency spectra. The frequency to be compared may be a predetermined specific frequency or may be obtained in relation to an estimated noise spectrum. The audio processing device 100 calculates a suppression amount for each of the frequency spectra based on a comparison result of a signal level in each of frequencies. Then, the audio processing device 100 performs suppression processing using the calculated suppression amount and outputs an audio signal to which a result of the suppression processing is reflected. The audio processing device 100 according to the first embodiment is included in, for example, a voice recorder or the like.

Figure 1:
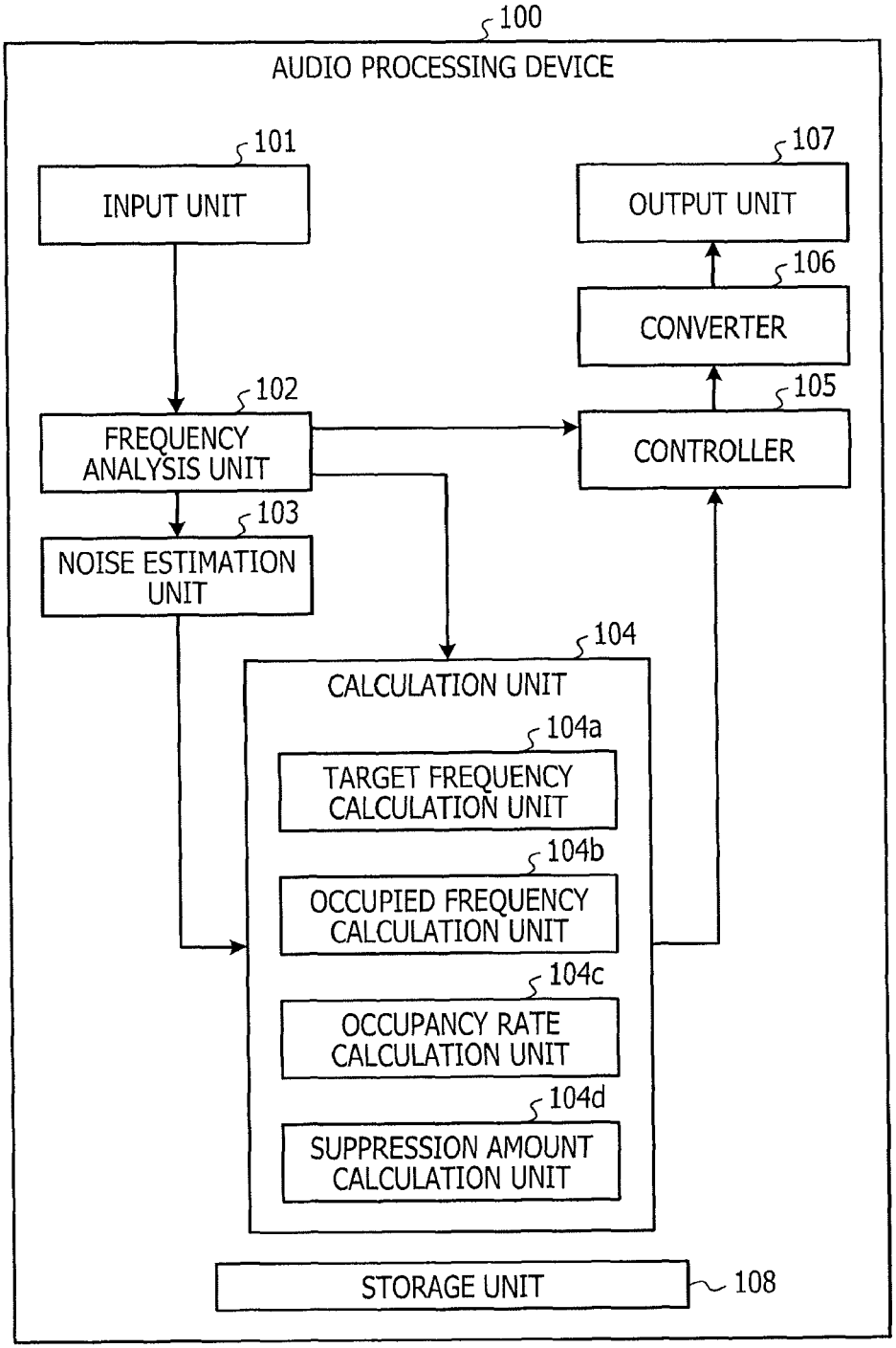
FIG. 1 is a diagram illustrating a configuration example of an audio processing device according to a first embodiment.

FIG. 1 is a diagram illustrating a configuration example of the audio processing device 100 according to the first embodiment.

As illustrated in FIG. 1, the audio processing device 100 according to the first embodiment includes an input unit 101, a frequency analysis unit 102, a noise estimation unit 103, a calculation unit 104, a controller 105, a converter 106, an output unit 107, and a storage unit 108. The calculation unit 104 includes a target frequency calculation unit 104*a*, an occupied frequency calculation unit 104*b*, an occupancy rate calculation unit 104*c*, and a suppression amount calculation unit 104*d*.

The input unit 101 receives audio from a plurality of input devices such as a microphone. The input unit 101 transforms the received audio into an audio signal by an analog/digital converter. However, already digitized signals may be received. In this case, an analog/digital conversion may be omitted.

The frequency analysis unit 102 analyzes a frequency of the audio signal obtained by the input unit 101. A method of frequency analysis will be described below. The frequency analysis unit 102 divides the audio signal digitized by the input unit 101 into frame units of the length of a predetermined length T (for example, 10 msec). Then, the frequency analysis unit 102 analyzes a frequency of an audio signal in each of frames. For example, the frequency analysis unit 102 performs short time fourier transform (STFT) and analyzes the frequency of the audio signal. However, a method of analyzing a frequency of an audio signal is not limited to the method described above.

The noise estimation unit 103 performs estimation of a noise spectrum included in a frequency spectrum calculated by the frequency analysis unit 102. The noise spectrum is a spectrum corresponding to a signal detected by the input device in a case where an audio signal is not input to the input device. As a method of calculating the noise spectrum, examples include a spectral subtraction method. However, a method of calculating the noise spectrum by the noise estimation unit 103 is not limited to the spectral subtraction method described above.

The target frequency calculation unit 104*a* of the calculation unit 104 specifies a frequency, which is a target of an audio analysis (hereinafter, referred to as a "target frequency"). The target frequency is a frequency used for calculating a suppression amount with respect to audio input to the audio processing device 100. Specifically, the target frequency calculation unit 104*a* compares amplitudes of an input frequency spectrum and an estimated noise spectrum for each of frequencies sampled at a predetermined interval. The target frequency calculation unit 104*a* sets a frequency at which an amplitude difference is equal to or greater than a predetermined value among the sampled frequencies to the target frequency. Then, the target frequency calculation unit 104*a* counts the number of target frequencies specified by the method described above and sets the total number as a total number of the target frequencies. The processing described above may be omitted, a predetermined frequency may be set as the target frequency, the target frequency may be counted, and the total number may be the total number of the target frequencies.

For each of the target frequencies calculated by the target frequency calculation unit 104*a*, the occupied frequency calculation unit 104*b* specifies a frequency spectrum having the largest signal level among the plurality of input frequency spectra. The occupied frequency calculation unit 104*b* counts the number of times each of the plurality of frequency spectra is specified as a frequency spectrum indicating the largest signal level and sets the total number as a total number of occupied frequencies in each of frequency spectra. Here, when calculating the total number of the occupied frequencies, it is not desirable to count only target frequencies indicating the largest signal level and set the counted number as the total number of the occupied frequencies, and it is preferable to count the number of target frequencies of which signal level is equal to or larger than a predetermined value for each of frequency spectra and set the counted number as the total number of the occupied frequencies.

Based on the total number of target frequencies calculated by the target frequency calculation unit 104*a* and the total number of occupied frequencies calculated by the occupied frequency calculation unit 104*b* for each of frequency spectra, the occupancy rate calculation unit 104*c* calculates an occupancy rate, which is a proportion of the total number of the occupied frequencies to the total number of the target frequencies. For this reason, as a frequency spectrum has a higher occupancy rate, it is a highly possible that audio corresponding to the frequency spectrum is a desired sound.

The suppression amount calculation unit 104*d* substitutes a predetermined occupancy rate obtained by the occupancy rate calculation unit 104*c* into a suppression amount calculation function and calculates a suppression amount for each of the plurality of frequency spectra. The suppression amount calculation unit 104*d* decreases a suppression amount as an occupancy rate of frequency spectra increases, and increases the suppression amount as the occupancy rate decreases.

The controller 105 multiplies a frequency spectrum generated by the frequency analysis unit 102 by the suppression amount calculated by the suppression amount calculation unit 104*d*, and performs suppression control to the plurality of frequency spectra. (Hereinafter, a frequency spectrum to which suppression control is performed is referred to as an estimation spectrum.)

The converter 106 performs short time fourier inverse transform to a frequency spectrum (estimation spectrum) to which suppression control is performed by the controller 105 and outputs an audio signal obtained after the inverse transform. (Hereinafter, an audio signal obtained by performing short time fourier inverse transform to the estimation spectrum is referred to as an estimation audio signal.)

The output unit 107 outputs the audio signal transformed by the converter 106.

The storage unit 108 stores information related to information or processing calculated by each of function units. Specifically, the storage unit 108 stores information desirable for processing in each of function units, such as audio input from the input device, an audio signal transformed by the input unit 101, a frequency spectrum analyzed by the frequency analysis unit 102, a noise spectrum estimated by the noise estimation unit 103, a spectrum calculated by the calculation unit 104, a target frequency, a total number of target frequencies, a total number of occupied frequencies, an occupancy rate, a suppression amount, an estimation spectrum generated by the controller 105 performing suppression control, an estimation audio signal transformed by the converter 106, and the like.

The audio processing device 100 may perform suppression control to all of frames corresponding to an input audio signal to determine whether or not the audio signal is output. Specifically, in a case where it is determined that suppression control for all of the frames does not end, the audio processing device 100 performs a series of processing described above to remaining frames. In addition, the audio processing device 100 may monitor input of the input unit 101, determine that suppression control already ends in a case where audio is not input for a predetermined time or more, and stop an operation of each of units except for the input unit 101.

Next, a processing flow of the audio processing device 100 according to the first embodiment will be described.

Figure 2:
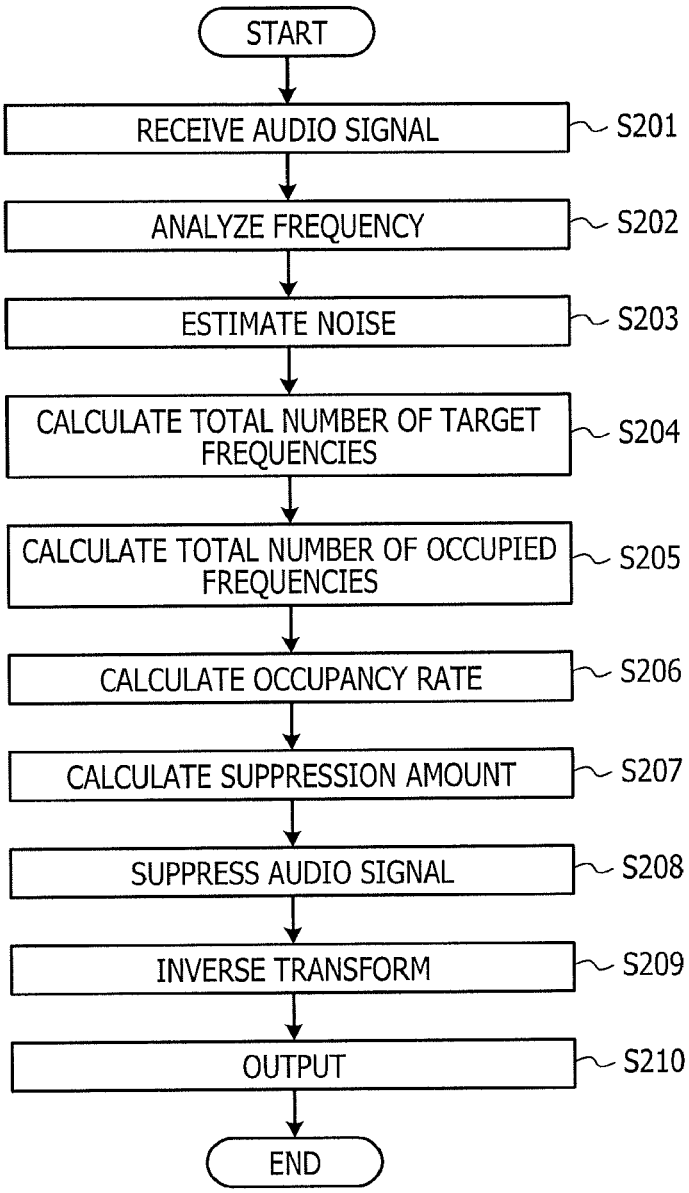
FIG. 2 is a diagram illustrating a processing flow of the audio processing device according to the first embodiment.

FIG. 2 is a diagram illustrating a processing flow of the audio processing device 100 according to the first embodiment. For example, processing will be described in which, in a case where audio signals are received from N input devices (2≤N), suppression control is performed to an audio signal xn(t) (1≤n≤N) received from an n-th input device.

In the audio processing device 100 according to the first embodiment, after the input unit 101 receives the audio signal xn(t) from the input device (step S201), the frequency analysis unit 102 analyzes a frequency of the audio signal xn(t) and calculates a frequency spectrum Xn(I, f) (step S202). I is a frame number, and f is a frequency. For the method of frequency analysis, for example, the method described in the frequency analysis unit 102 is used.

The noise estimation unit 103 of the audio processing device 100 estimates a noise spectrum Nn(I, f) from the frequency spectrum calculated by the frequency analysis unit 102 for the audio signal (step S203). A method of calculating a noise estimation spectrum is, for example, the spectral subtraction method mentioned in the noise estimation unit 103. The target frequency calculation unit 104*a* of the calculation unit 104 calculates a target frequency based on the frequency spectrum Xn(I, f) analyzed a frequency by the frequency analysis unit 102 and the noise spectrum Nn(I, f) estimated by the noise estimation unit 103. As a calculation method of the target frequency, for example, a signal-noise threshold (SNTH) is set and in a case where there is a frequency f corresponding to Equation 1 among frequencies f of the frequency spectrum Xn(I, f), it is determined that the frequency f is a target frequency.

$$Xn(I,f)-Nn(I,f)>SNTH \tag{1}$$

As represented in Equation 1, in a case where an amplitude difference between a frequency spectrum and a noise spectrum is larger than SNTH, the target frequency calculation unit 104*a* of the audio processing device 100 determines that a frequency f is a target frequency. The signal-noise threshold may be set by a user in advance and may be calculated based on a difference between a frequency spectrum and a noise spectrum. As a method of calculating, for example, an average value of a difference between a frequency spectrum and a noise spectrum in a frame is set as SNTH.

The target frequency calculation unit 104*a* of the audio processing device 100 calculates a total number of target frequencies flm as a total number M of target frequencies (step S204). flm is an m-th (1≤m≤M) frequency fin an I frame determined to be an audio analysis target. The occupied frequency calculation unit 104*b* of the audio processing device 100 calculates a total number bn(I) of occupied frequencies in the I frame of each of a plurality of frequency spectra Xm(I, f) with respect to each of the target frequencies calculated by the target frequency calculation unit 104*a* (step S205). Equation 2 represents an equation used when the occupied frequency calculation unit 104*b* of the audio processing device 100 calculates the total number bn(I) of occupied frequencies of the frequency spectrum Xn(I, f).

$$bn(l) = \sum_{m=1}^{M} F(f_{lm}) \begin{cases} F(f_{lm}) = 1 & (Xn(l, f_{lm}) = \mathrm{Max}Xo(l, f_{lp})) \\ F(f_{lm}) = 0 & (Xn(l, f_{lm}) \neq \mathrm{Max}Xo(l, f_{lp})) \end{cases} \tag{2}$$

$$(1 \le o \le N), (1 \le p \le M)$$

The occupancy rate calculation unit 104*c* of the audio processing device 100 calculates an occupancy rate shn(I) in the I frame of each of the frequency spectra Xn(I, f) based on the total number M of the target frequencies calculated by the target frequency calculation unit 104*a* and the total number bn(I) of occupied frequencies calculated by the occupied frequency calculation unit 104*b* (step S206). An equation used when calculating the occupancy rate shn(I) is represented by Equation 3.

$$shn(I)=bn(I)/M \tag{3}$$

Figure 3:
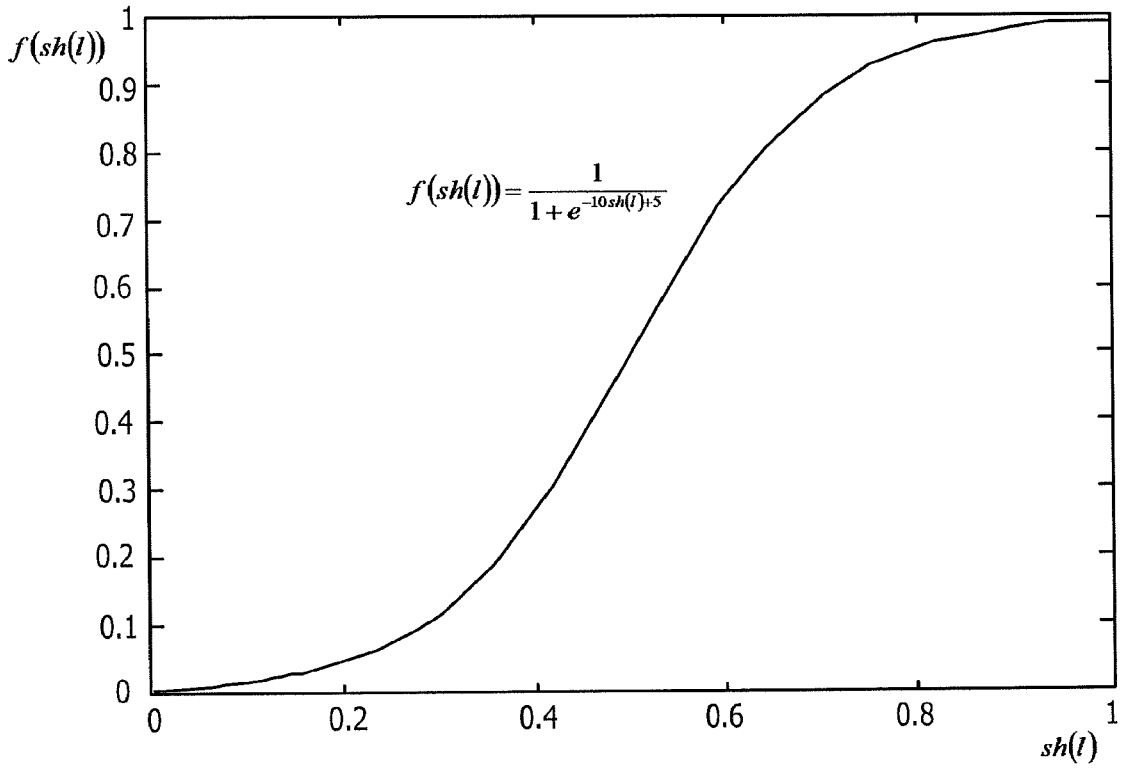
FIG. 3 is a diagram illustrating a graph of a suppression amount calculation function.

After calculating the occupancy rate shn(I) by the occupancy rate calculation unit 104*c*, the suppression amount calculation unit 104*d* of the audio processing device 100 calculates a suppression amount Gn(I, f) (step S207). An equation used when calculating the suppression amount Gn(I, f) is represented by Equation 4 and a graph of the suppression amount calculation function is illustrated in FIG. 3.

$$Gn(l, f) = f(shn(l)) = \frac{1}{1 + e^{-10shn(l)+5}} \tag{4}$$

The controller 105 of the audio processing device 100 performs suppression of the frequency spectrum Xn(I, f) and calculates an estimation spectrum Sn(I, f) based on the suppression amount Gn(I, f) calculated by the suppression amount calculation unit 104*d* (step S208). An equation used when calculating the estimation spectrum Sn(I, f) is represented by Equation 5.

$$Sn(I,f)=Gn(I,f)\times Xn(I,f) \tag{5}$$

The converter 106 of the audio processing device 100 performs short time fourier inverse transform to the estimation spectrum Sn(I, f) to which suppression is performed and calculates an estimation audio signal sn(t) (step S209), and the output unit 107 outputs the estimation audio signal sn(t) (step S210).

As described above, by suppressing in accordance with an occupancy rate of each of frequency spectra, even if an undesired sound increases temporarily, it is possible to analyze audio with high accuracy.

Next, an audio processing device 100 according to a second embodiment will be described.

The audio processing device 100 according to the second embodiment calculates an occupancy rate by using a smoothed spectrum obtained by smoothing a frequency spectrum between frames. By performing a smoothing process, even if a sudden change (for example, generation of sudden noise) occurs in the frequency spectrum between the frames, the audio processing device 100 can reduce an influence of the change and perform audio processing. For example, the audio processing device 100 according to the second embodiment includes a plurality of N microphones connected to a personal computer as input devices provided in the personal computer.

Figure 4:
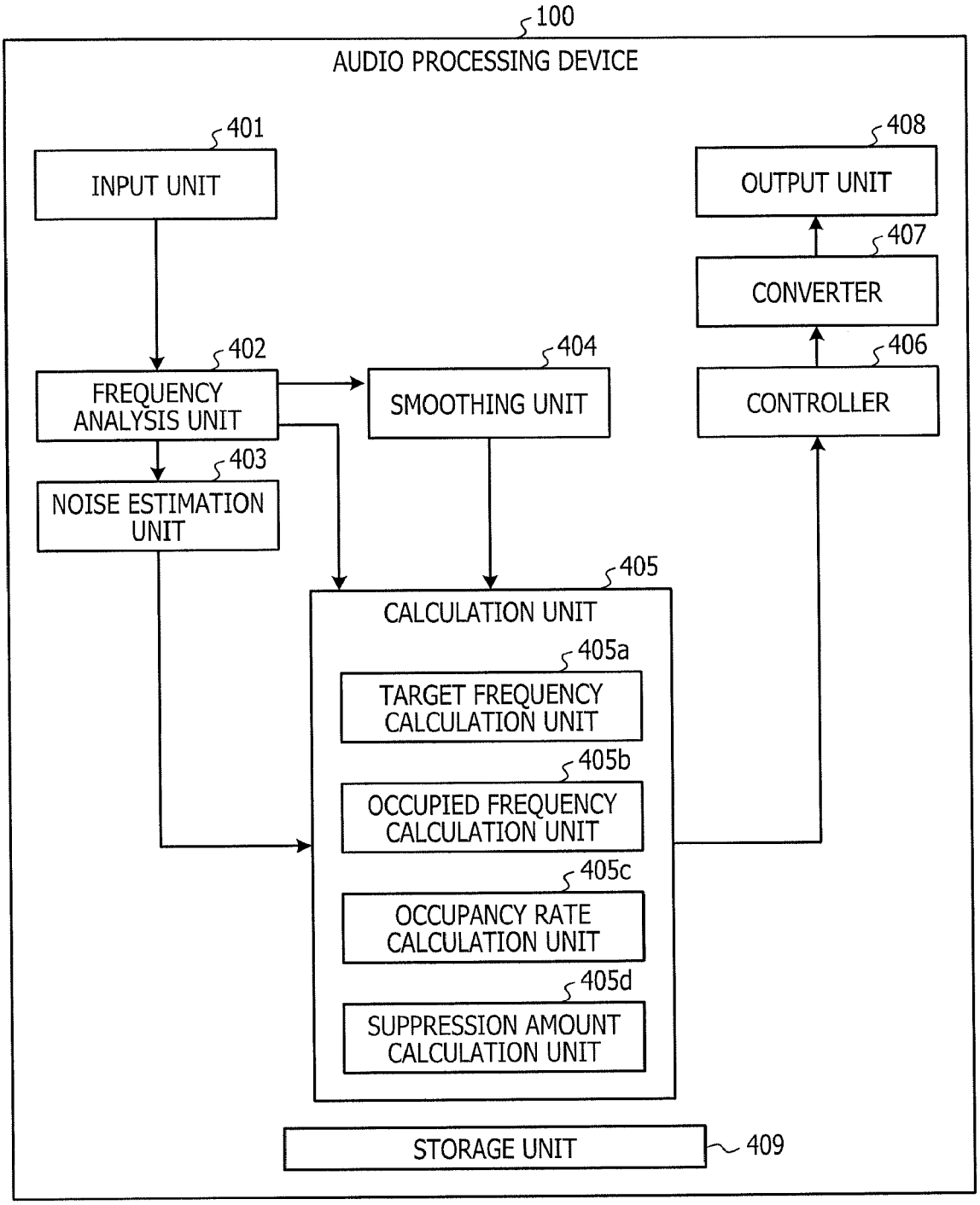
FIG. 4 is a diagram illustrating a configuration example of an audio processing device according to a second embodiment.

FIG. 4 is a diagram illustrating a configuration example of the audio processing device 100 according to the second embodiment.

The audio processing device 100 according to the second embodiment includes an input unit 401, a frequency analysis unit 402, a noise estimation unit 403, a smoothing unit 404, a calculation unit 405, a controller 406, a converter 407, an output unit 408, and a storage unit 409. The calculation unit 405 include a target frequency calculation unit 405*a*, an occupied frequency calculation unit 405*b*, an occupancy rate calculation unit 405*c*, and a suppression amount calculation unit 405*d*. Other than the smoothing unit 404, the calculation unit 405, and the controller 406, the same processing as each of function units in the configuration of the audio processing device 100 according to the first embodiment is performed.

The smoothing unit 404 performs smoothing using a frequency spectrum generated by the frequency analysis unit 402 and a frequency spectrum in a frame different from the frequency spectrum and generates a smoothed spectrum.

The target frequency calculation unit 405*a* calculates a target frequency. The target frequency calculation unit 405*a* assumes that ½ of a sampling frequency of a frequency spectrum from 0 Hz to input audio is the target frequency. Then, the target frequency calculation unit 405*a* counts the number of target frequencies specified by the method described above and sets the total number as a total number of the target frequencies.

For each of the target frequencies calculated by the target frequency calculation unit 405*a*, the occupied frequency calculation unit 405*b* specifies a smoothed spectrum having the largest signal level among a plurality of smoothed spectra. The occupied frequency calculation unit 405*b* counts the number of times each of the plurality of smoothed spectra is specified as a smoothed spectrum indicating the largest signal level and sets the total number as a total number of occupied frequencies in each of smoothed spectra.

Based on a total number of target frequencies calculated by the target frequency calculation unit 405*a* and a total number of occupied frequencies calculated by the occupied frequency calculation unit 405*b*, the occupancy rate calculation unit 405*c* calculates an occupancy rate of each of the plurality of smoothed spectra.

The suppression amount calculation unit 405*d* calculates a suppression amount based on a noise spectrum estimated by the noise estimation unit 403, a smoothed spectrum calculated by the smoothing unit 404, and an occupancy rate calculated by the occupancy rate calculation unit 405*c*. The suppression amount calculation unit 405*d* decreases a suppression amount as an occupancy rate of smoothed spectra increases, and increases the suppression amount as the occupancy rate decreases.

The controller 406 multiplies a frequency spectrum generated by the frequency analysis unit 402 by the suppression amount calculated by the suppression amount calculation unit 405*d*, and performs suppression control to the plurality of frequency spectra.

Next, a processing flow of the audio processing device 100 according to the second embodiment will be described.

Figure 5:
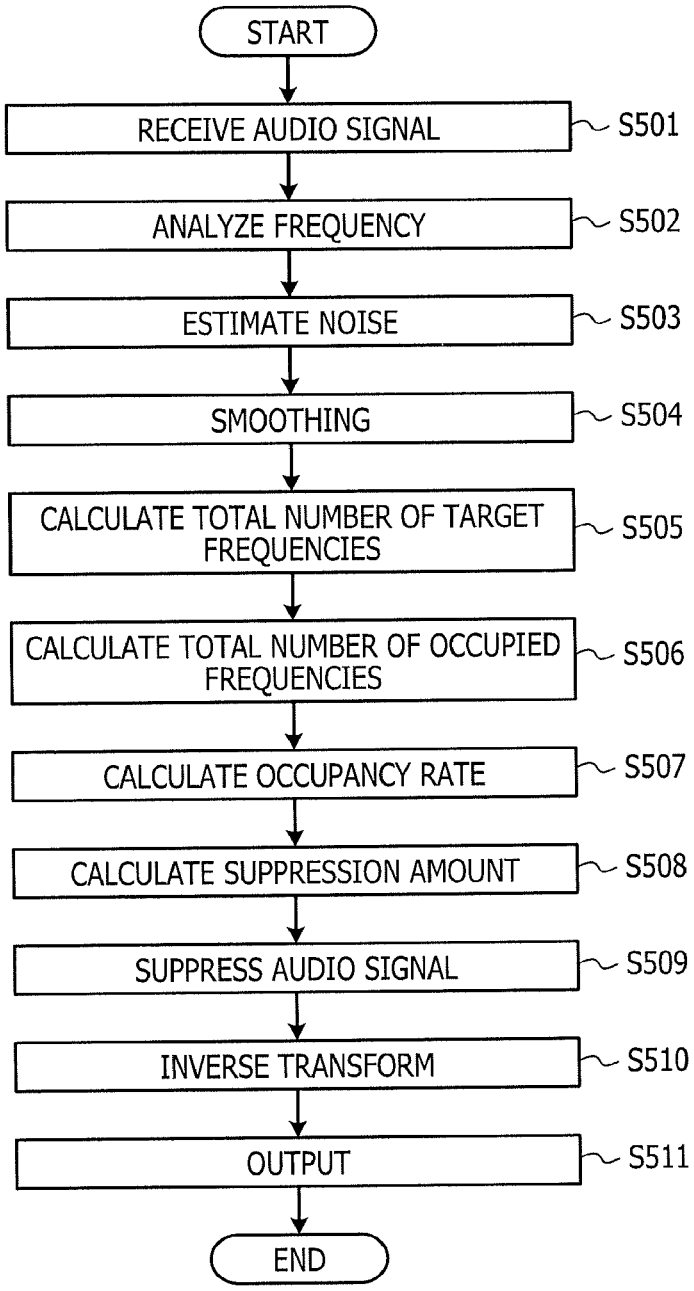
FIG. 5 is a diagram illustrating a processing flow of the audio processing device according to the second embodiment.

FIG. 5 is a diagram illustrating a processing flow of the audio processing device 100 according to the second embodiment. In the same manner as the first embodiment, also in the second embodiment, processing in which, in a case where audio signals are received from N input devices (2≤N), suppression control is performed to an audio signal xn(t) (1≤n≤N) input from an n-th input device will be described.

In the audio processing device 100 according to the second embodiment, after the input unit 401 receives input of the audio signal xn(t) (step S501), the frequency analysis unit 402 analyzes a frequency of the audio signal xn(t) which receives the input and calculates a frequency spectrum Xn(I, f) (step S502). I is a frame number, and f is a frequency.

The noise estimation unit 403 of the audio processing device 100 estimates a noise spectrum Nn(I, f) from the frequency spectrum Xn(I, f) calculated by the frequency analysis unit 402 (step S503). Processing of calculating the noise spectrum is the same as the processing of the noise estimation unit 103 in the first embodiment.

The smoothing unit 404 of the audio processing device 100 performs smoothing to the frequency spectrum Xn(I, f) calculated by the frequency analysis unit 402 and calculates a smoothed spectrum X'n(I, f) (step S504). An equation used when calculating the smoothed spectrum X'n(I, f) is represented by Equation 6.

$$X'n(I,f)=(1-a)\times X'n(I-1,f)+a\times Xn(I,f) \tag{6}$$

However, in a first frame, since there is no preceding frame of the first frame, a smoothed spectrum X'1(I, f) is set as a frequency spectrum X1(I, f).

In the same manner as the first embodiment, after the target frequency calculation unit 405*a* of the audio processing device 100 calculates a target frequency flm of an audio analysis and a total number M of target frequencies (step S505), the occupied frequency calculation unit 405*b* calculates an occupied frequency b'n(I) in a smoothed spectrum of each of input audio signals (step S506). A calculation method of the target frequency flm of the audio analysis and the total number M of the target frequencies is a method described in explanation of the target frequency calculation unit 405*a*. An equation used when calculating the occupied frequency b'n(I) is represented by Equation 7.

$$b'n(l)=\sum_{m=1}^{M}F(f_{lm})\begin{cases}F(f_{lm})=1 & (X'n(l,f_{lm})=\mathrm{Max}X'o(l,f_{lp}))\\ F(f_{lm})=0 & (X'n(l,f_{lm})\neq\mathrm{Max}X'o(l,f_{lp}))\end{cases} \tag{7}$$

$$(1\le o\le N),\ (1\le p\le M)$$

The occupancy rate calculation unit 405*c* of the audio processing device 100 calculates an occupancy rate sh'n(I) based on the total number M of the target frequencies which is an audio analysis target calculated by the target frequency calculation unit 405*a* and the occupied frequency b'n(I) in a smoothed spectrum of each of the input audio signals calculated by the occupied frequency calculation unit 405*b* (step S507). An equation used when calculating the occupancy rate sh'n(I) is represented by Equation 8.

$$sh'n(I)=b'n(I)/M \tag{8}$$

Based on the noise spectrum Nn(I, f) calculated by the noise estimation unit 403, the smoothed spectrum X'n(I, f) calculated by the smoothing unit 404, the occupancy rate sh'n(I) calculated by the occupancy rate calculation unit 405*c*, a first state determination threshold TH1, and a second state determination threshold TH2 (TH2<TH1), the suppression amount calculation unit 405*d* of the audio processing device 100 calculates a suppression amount G'n(I, f) for a frequency spectrum (step S508). An equation used when calculating the suppression amount G'n(I, f) is represented by Equation 9.

$$G'n(l,f)=\begin{cases}1 & \left(\begin{array}{c}sh'n(l)>TH1\\ TH2\le sh'n(l)\le TH1\ \text{and}\\ X'n(l,f_{lm})=\mathrm{Max}X'o(l,f_{lp})\end{array}\right)\\ \dfrac{Nn(l,f}{X'n(l,f)} & \left(\begin{array}{c}TH2\le sh'n(l)\le TH1\ \text{and}\\ X'n(l,f_{lm})\neq\mathrm{Max}X'o(l,f_{lp})\\ sh'n(l)<TH2\end{array}\right)\end{cases} \tag{9}$$

$$(1\le o\le N),\ (1\le p\le M)$$

The first state determination threshold TH1 and/or the second state determination threshold TH2 in Equation 9 may be set by a user and may be set by the audio processing device 100 based on a frequency spectrum. For example, a case where a setting of TH1=0.7 and TH2=0.3 is received from the user will be described. When an occupancy rate of a frequency spectrum is equal to or larger than the first state determination threshold TH1 0.7, the suppression amount calculation unit 405*d* of the audio processing device 100 sets a suppression amount G'm(I, f) of an audio signal=1. In addition, when the occupancy rate of the frequency spectrum is between the first state determination threshold TH1 0.7 and the second state determination threshold TH2 0.3 and is larger than a smoothed spectrum corresponding to an input audio signal received from another input device, the suppression amount calculation unit 405*d* of the audio processing device 100 sets the suppression amount G'n(I, f)=1.

On the other hand, when the occupancy rate of the frequency spectrum is between the first state determination threshold TH1 0.7 and the second state determination threshold TH2 0.3 and is smaller than a smoothed spectrum corresponding to an input audio signal received from another input device, the suppression amount calculation unit 405*d* of the audio processing device 100 sets the suppression amount G'n(I, f)=Nn(I, f)/X'n(I, f). The suppression amount calculation unit 405*d* of the audio processing device 100 sets the suppression amount to Nn(I, f)/X'n(I, f) so as to suppress an undesired sound to a level of a noise spectrum and to calculate the undesired sound as a more natural frequency spectrum. In addition, when the occupancy rate of the frequency spectrum is smaller than the second state determination threshold TH2 0.3, the suppression amount calculation unit 405*d* of the audio processing device 100 sets the suppression amount G'n(I, f)=Nn(I, f)/X'n(I, f).

The controller 406 of the audio processing device 100 performs suppression of an audio signal to the frequency spectrum Xn(I, f) and calculates an estimation spectrum S'n(I, f) based on the suppression amount G'n(I, f) calculated by the suppression amount calculation unit 405*d* (step S509). An equation used when calculating the estimation spectrum S'n(I, f) is represented by Equation 10.

$$S'n(I,f)=G'n(I,f)\times Xn(I,f) \tag{10}$$

In the audio processing device 100, the controller 406 performs suppression of an audio signal and calculates the estimation spectrum S'n(I, f), the converter 407 inverse-transforms the estimation spectrum S'n(I, f) into an audio signal s'n(t) (step S510), and the output unit 408 outputs a signal after inverse transform (step S511).

As described above, by smoothing and suppressing each of frequency spectra, even if sudden noise occurs, it is possible to suppress this influence and analyze audio with high accuracy.

Next, an audio processing device 100 according to a third embodiment will be described.

The audio processing device 100 according to the third embodiment calculates performs suppression control based on a long-term occupancy rate calculated using an occupancy rate in a past frame. By calculating a suppression amount based on the long-term occupancy rate, even if there is a sudden change in an occupancy rate between frames, it is possible to reduce an influence of the change and to perform audio processing. The audio processing device 100 according to the third embodiment provides, for example, cloud computing or the like, and receives and processes input audio recorded in a recording device capable of communicating with a cloud server via the Internet network.

Figure 6:
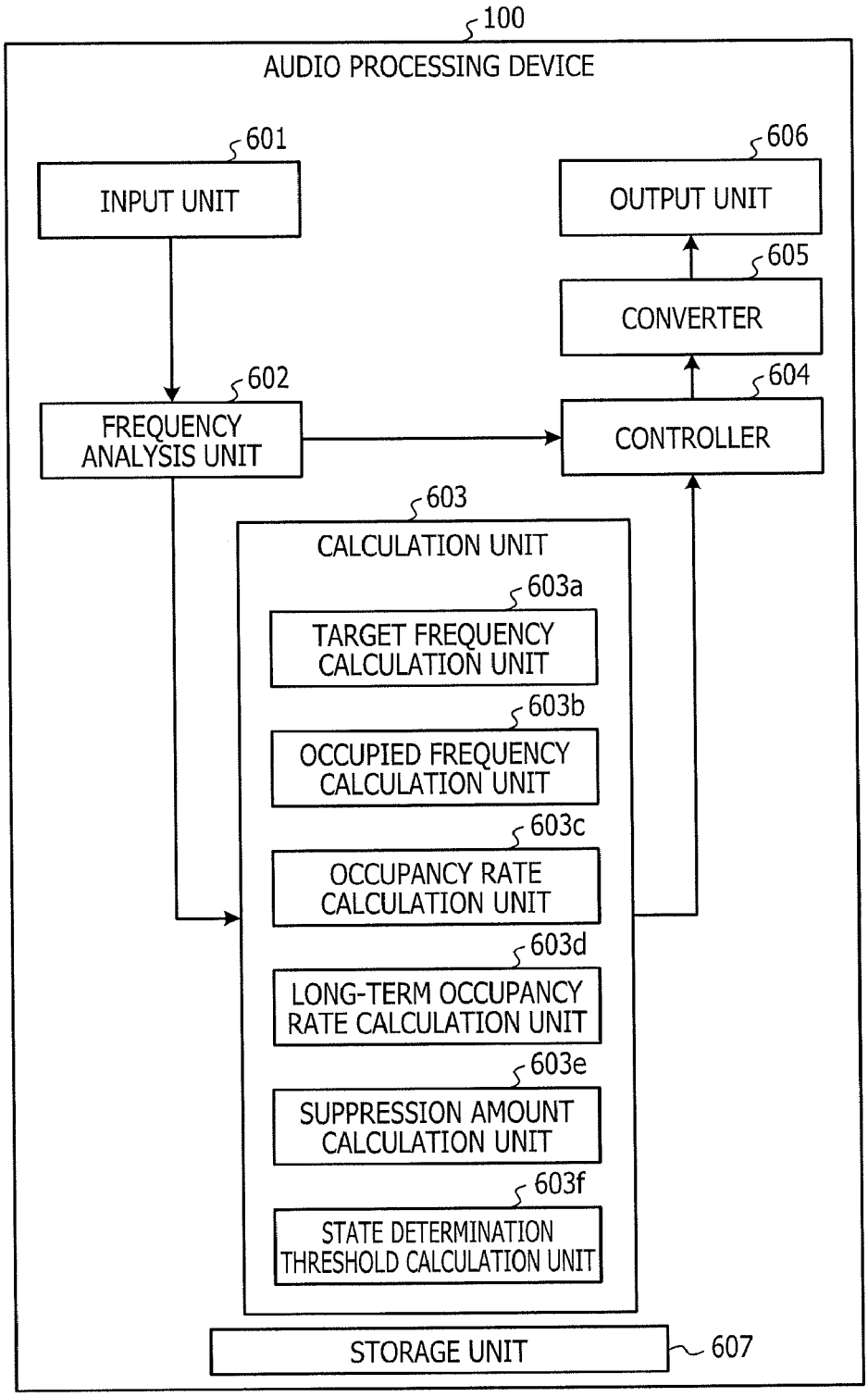
FIG. 6 is a diagram illustrating a configuration example of an audio processing device according to a third embodiment.

FIG. 6 is a diagram illustrating a configuration example of the audio processing device 100 according to the third embodiment.

The audio processing device 100 according to the third embodiment includes an input unit 601, a frequency analysis unit 602, a calculation unit 603, a controller 604, a converter 605, an output unit 606, and a storage unit 607. The calculation unit 603 includes a target frequency calculation unit 603*a*, an occupied frequency calculation unit 603*b*, an occupancy rate calculation unit 603*c*, a long-term occupancy rate calculation unit 603*d*, a suppression amount calculation unit 603*e*, and a state determination threshold calculation unit 603*f*. The input unit 601, the frequency analysis unit 602, the controller 604, the converter 605, the output unit 606, and the storage unit 607 perform the same processing as each of function units of the audio processing device 100 according to the first embodiment. The target frequency calculation unit 603*a* of the calculation unit 603 performs the same processing as the target frequency calculation unit 405*a* of the audio processing device 100 according to the second embodiment. The occupied frequency calculation unit 603*b* and the occupancy rate calculation unit 603*c* perform the same processing as the occupied frequency calculation unit 104*b* and the occupancy rate calculation unit 104*c* in the audio processing device 100 according to the first embodiment.

Based on an occupancy rate calculated by the occupancy rate calculation unit 603*c*, an occupancy rate of each of frequency spectra in frames different from each other, and a weighting coefficient, the long-term occupancy rate calculation unit 603*d* calculates a long-term occupancy rate of each of the frequency spectra. The weighting coefficient is for adjusting magnitude of an influence of an occupancy rate of each of frames in the long-term occupancy rate when calculating the long-term occupancy rate.

The suppression amount calculation unit 603*e* calculates a suppression amount based on a frequency spectrum generated by the frequency analysis unit 602, a long-term occupancy rate in each of frequency spectra calculated by the long-term occupancy rate calculation unit 603*d*, and a third state determination threshold TH3 and a fourth state determination threshold TH4 of which settings are received in advance.

In a case where a frame of a frequency spectrum to which suppression control is performed is within predetermined frames during device operation, the state determination threshold calculation unit 603*f* adjusts the third state determination threshold TH3 and the fourth state determination threshold TH4 used by the suppression amount calculation unit 603*e*.

Next, a processing flow of the audio processing device 100 according to the third embodiment will be described.

Figure 7:
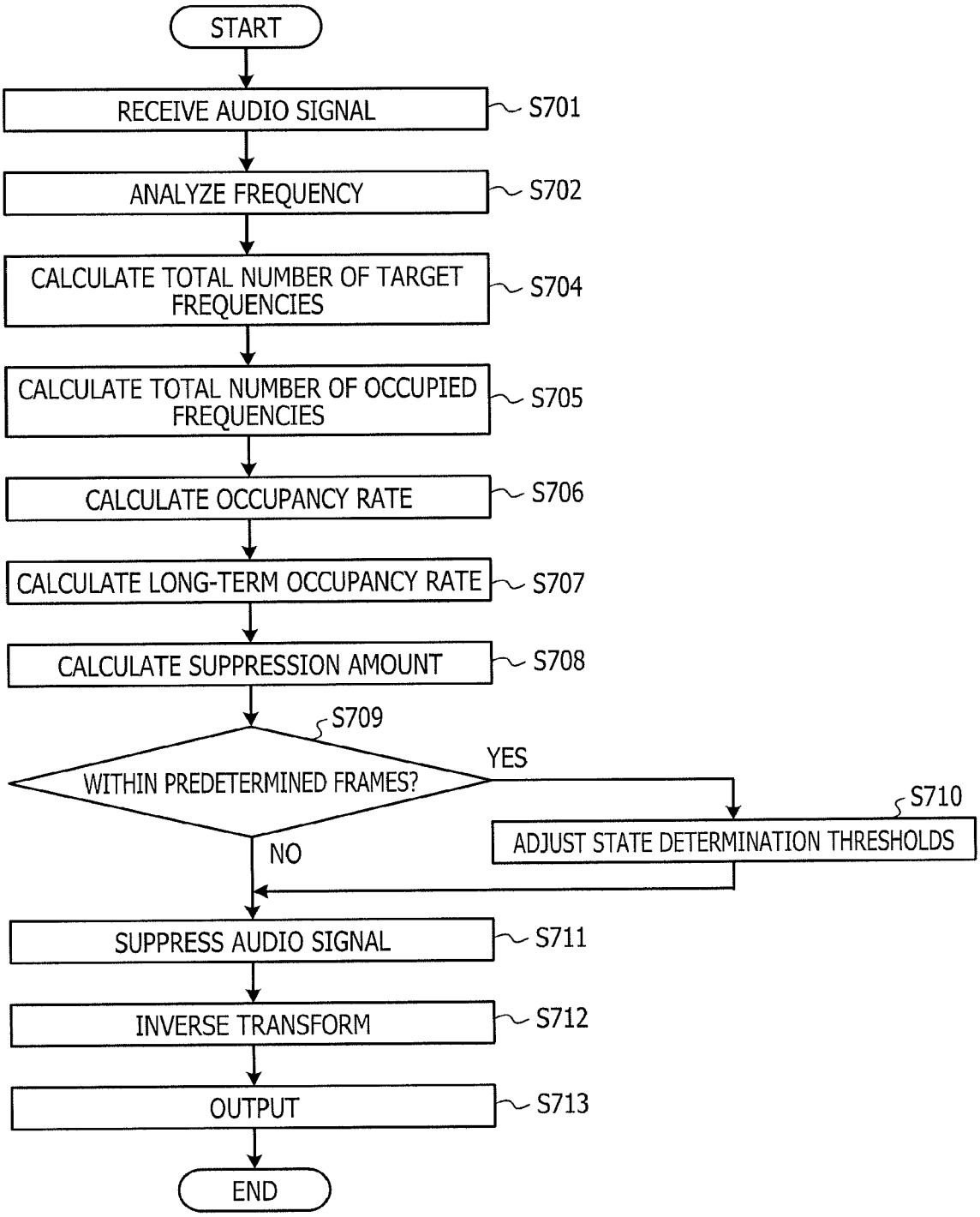
FIG. 7 is a diagram illustrating a processing flow of the audio processing device according to the third embodiment.

FIG. 7 is a diagram illustrating a processing flow of the audio processing device 100 according to the third embodiment. In the same manner as the first embodiment, also in the third embodiment, processing in which, in a case where audio signals are received from N input devices (2≤N), suppression control is performed to an audio signal xn(t) (1≤n≤N) input from an n-th input device will be described.

In the audio processing device 100 according to the third embodiment, after the input unit 601 receives an audio signal xn(t) from the input device (step S701), the frequency analysis unit 602 analyzes a frequency of the received audio signal xn(t) and calculates a frequency spectrum Xn(I, f) (step S702).

In the audio processing device 100, after the target frequency calculation unit 603*a* calculates a total number M of target frequencies (step S704), the occupied frequency calculation unit 603*b* calculates a total number bn(I) of occupied frequencies (step S705). Processing of calculating the total number M of the target frequencies and the total number bn(I) of the occupied frequencies is the same as steps S505 and S506 in the second embodiment. In the audio processing device 100, the occupancy rate calculation unit 603*c* calculates an occupancy rate in the same manner as the first embodiment (step S706) and based on the calculated occupancy rate, the long-term occupancy rate calculation unit 603*d* calculates a long-term occupancy rate Ishn(I) (step S707). An equation used when calculating the long-term occupancy rate Ishn(I) is represented by Equation 11.

$$Ishn(I)=(1-\beta)\times Ishn(I-1)+\beta\times shn(I) \tag{11}$$

however, in a first frame, since there is no preceding frame of the first frame, the long-term occupancy rate Ishn(I) is set as an occupancy rate Ishn(I). β is a weighting coefficient. For example, a value of β may be set in advance by the user (for example, β=0.6) and the value may be adjusted when the following condition is satisfied.

In a case where a difference between a maximum value A and a minimum value B of the occupancy rate shn(I) in a current frame to be calculated and a frame in a past predetermined period is larger than a first change threshold VTH1 and a difference between an occupancy rate shn(I−1, f) of a preceding frame and an occupancy rate shn(I, f) of a target frame to which calculation of the estimation spectrum is performed is larger than a second change threshold VTH2, the long-term occupancy rate calculation unit 603*d* of the audio processing device 100 performs processing of increasing β (for example, adding 0.1). By this processing, in a case where there is a large difference in occupancy rates between each of frames and a preceding frame, by increasing an influence of a current frame to be calculated, it is possible to calculate the long-term occupancy rate Ishn(I) more reflected an occupancy rate of a current frame.

Based on the third state determination threshold TH3 and the fourth state determination threshold TH4 (TH3<TH4), a frequency spectrum Xn(I, f) calculated by the frequency analysis unit 602, and a long-term occupancy rate Ishn(I) calculated by the long-term occupancy rate calculation unit 603*d*, the suppression amount calculation unit 603*e* of the audio processing device 100 calculates a suppression amount G"n(I, f) (step S708). The third state determination threshold TH3 and the fourth state determination threshold TH4 are set in advance by the user. An equation used when calculating the suppression amount G"n(I, f) is represented by Equation 12.

$$G''n(l,f)=\begin{cases} 1 & \left(\begin{array}{c} lshn(l)>TH3 \\ TH4\le lshn(l)\le TH3 \text{ and} \\ X'n(l,f_{im})=\mathrm{Max}X'o(l,f_{ip}) \end{array}\right) \\ 0 & \left(\begin{array}{c} TH4\le slhn(l)\le TH3 \text{ and} \\ X'n(l,f_{im})\ne \mathrm{Max}X'o(l,f_{ip}) \\ lshn(l)<TH4 \end{array}\right) \end{cases} \tag{12}$$

$$(1\le o\le N),\ (1\le p\le M)$$

The state determination threshold calculation unit 603*f* of the audio processing device 100 determines whether or not a frame to be calculated is within predetermined frames (for example, within 21 frames after operating the device) (step S709). In a case where it is determined that the frame to be calculated is within the predetermined frames after operating the device (Yes in step S709), the state determination threshold calculation unit 603*f* of the audio processing device 100 adjusts the third state determination threshold TH3 and the fourth state determination threshold TH4 based on a relationship between the long-term occupancy rate Ishn(I) and a first correction threshold value CTH1 or a second correction threshold value CTH2 (CTH1<CTH2) (step S710). For example, in a case where the long-term occupancy rate Ishn(I) is smaller than the first correction threshold value CTH1 and larger than the second correction threshold value CTH2, since there is a difference in sizes of undesired sound input to a plurality of input devices and there is a possibility that an occupancy rate is affected, it is desired to perform adjusting. By adjusting the third state determination threshold TH3 and the fourth state determination threshold TH4 in a period of operation of the device (period during which a desired sound is not input), it is possible to suppress an influence of an occupancy rate of an undesired sound in a analysis of the frequency spectrum. An equation used when adjusting the third state determination threshold TH3 and the fourth state determination threshold TH4 is represented by Equation 13.

$$TH3=TH3-(0.5-C)TH4=TH4-(0.5-C) \tag{13}$$

C is an average value of the long-term occupancy rate Ishn(I) in a predetermined frame. In a case where a value of the long-term occupancy rate is small (an occupancy rate becomes small due to an influence of noise input to another input device), since it is desired to accurately determine whether or not audio is a desired sound even if an occupancy rate of an audio signal input to the input device is small, the state determination threshold calculation unit 603*f* of the audio processing device 100 decrease the third state determination threshold TH3 and the fourth state determination threshold TH4. On the other hand, in a case where a value of the long-term occupancy rate is large (an occupancy rate becomes large due to an influence of large noise input to the input device compared with another input device), since it is desired to determine that an audio signal is a desired sound when an occupancy rate of the audio signal input to the input device is larger than an occupancy rate of only an undesired sound, the state determination threshold calculation unit 603*f* of the audio processing device 100 increases a threshold for determining whether or not input audio is the desired sound. In a case where it is determined that the frame to be calculated is not within the predetermined frames after operating the device (No in step S709), the controller 604 of the audio processing device 100 calculates a estimation spectrum S"n(I, f) performing suppression of an audio signal based on the suppression amount G"n(I, f) calculated by the suppression amount calculation unit 603*e* and the frequency spectrum Xn(I, f) (step S711). An equation used when calculating the estimation spectrum S"n(I, f) is represented by Equation 14.

$$S''n(I,f)=G''n(I,f)\times Xn(I,f) \tag{14}$$

After the controller 604 performs suppression of the audio signal, the converter 605 of the audio processing device 100 performs inverse transform to the estimation spectrum S"n(I, f) (step S712) and calculates an estimation audio signal s"n(t), and the output unit 606 outputs the estimation audio signal s"n(t) (step S713). As described above, by adjusting an occupancy rate, even if a speaker changes, it is possible to analyze audio with high accuracy.

Next, an audio processing device 100 according to a fourth embodiment will be described.

The audio processing device 100 according to the fourth embodiment calculates an occupancy rate based on an occupancy time calculated by comparing a magnitude correlation of audio signals input from each of input terminals. By processing describe above, it is possible to adjust time (frame size) during which suppression is performed and it is possible to perform suppression control to an audio signal at each time.

Figure 8:
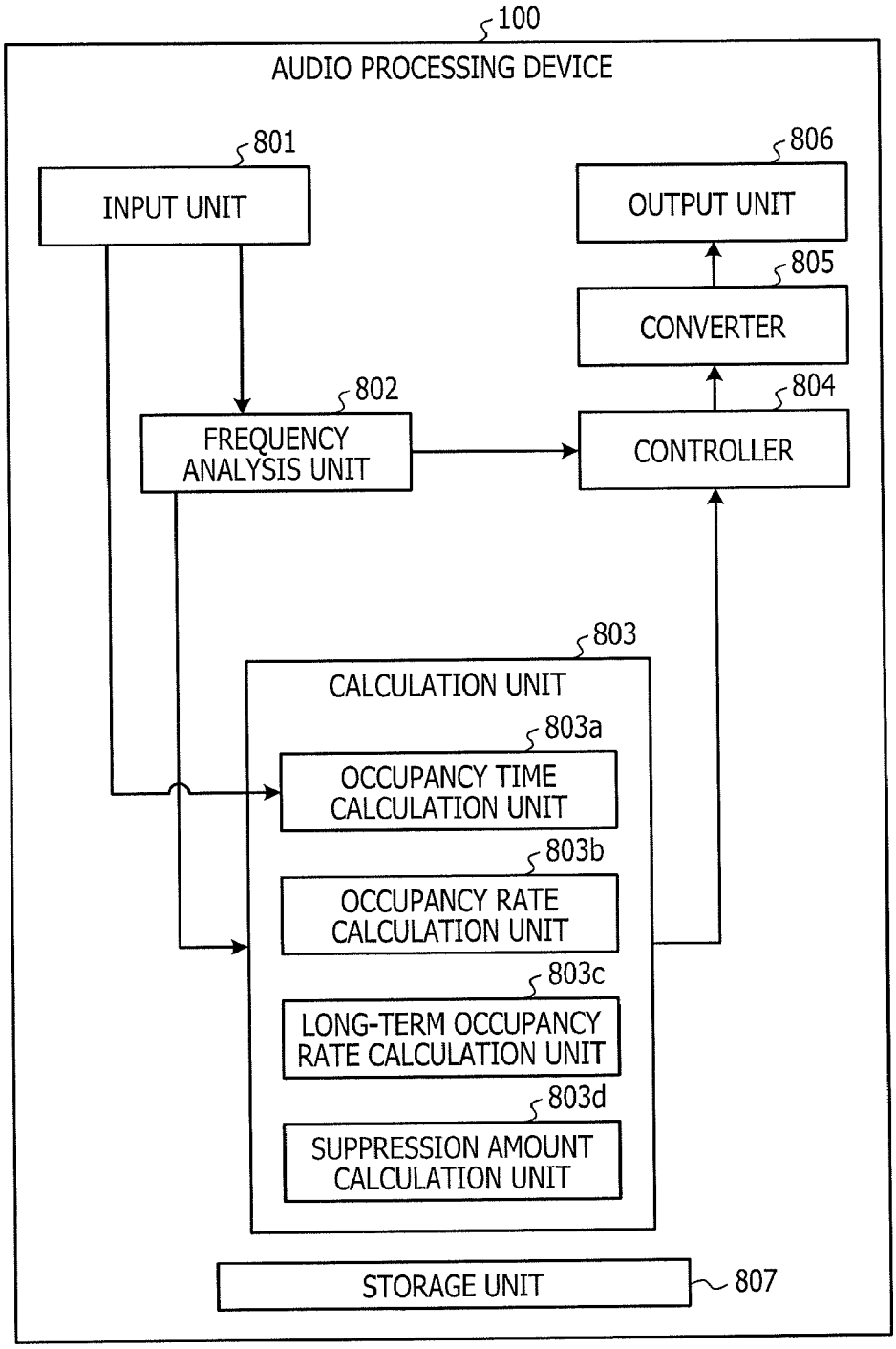
FIG. 8 is a diagram illustrating a configuration example of an audio processing device according to a fourth embodiment.

FIG. 8 is a diagram illustrating a configuration example of the audio processing device 100 according to the fourth embodiment. As illustrated in FIG. 8, the audio processing device 100 according to the fourth embodiment includes an input unit 801, a frequency analysis unit 802, a calculation unit 803, a controller 804, a converter 805, an output unit 806, and a storage unit 807. The calculation unit 803 includes an occupancy time calculation unit 803*a*, an occupancy rate calculation unit 803*b*, a long-term occupancy rate calculation unit 803*c*, and a suppression amount calculation unit 803*d*. The input unit 801, the frequency analysis unit 802, the controller 804, the converter 805, the output unit 806, and the storage unit 807 perform the same processing as each of function units of the audio processing device 100 according to the first embodiment.

The occupancy time calculation unit 803*a* compares sizes of audio signals for each unit time (for example, 5 msec) included in a predetermined time set in advance and calculates an occupancy time indicating an area where a sound signal is larger than an audio signal input from another input device. As the occupancy time of an audio signal is longer, there is a high possibility that the audio signal is a desired sound.

Based on the occupancy time calculated by the occupancy time calculation unit 803*a* and a predetermined time, the occupancy rate calculation unit 803*b* calculates an occupancy rate for each of audio signals.

The long-term occupancy rate calculation unit 803*c* calculates a mode value included in an occupancy rate calculated by the occupancy rate calculation unit 803*b* and an occupancy rate in a plurality of predetermined times in the past as a long-term occupancy rate. However, the long-term occupancy rate is not limited to the mode, for example, may be an average value or a median value of occupancy rates in the plurality of predetermined times.

The suppression amount calculation unit 803*d* calculates a suppression amount for each of frequency spectra based on a value of the long-term occupancy rate calculated by the long-term occupancy rate calculation unit 803*c*.

Figure 9:
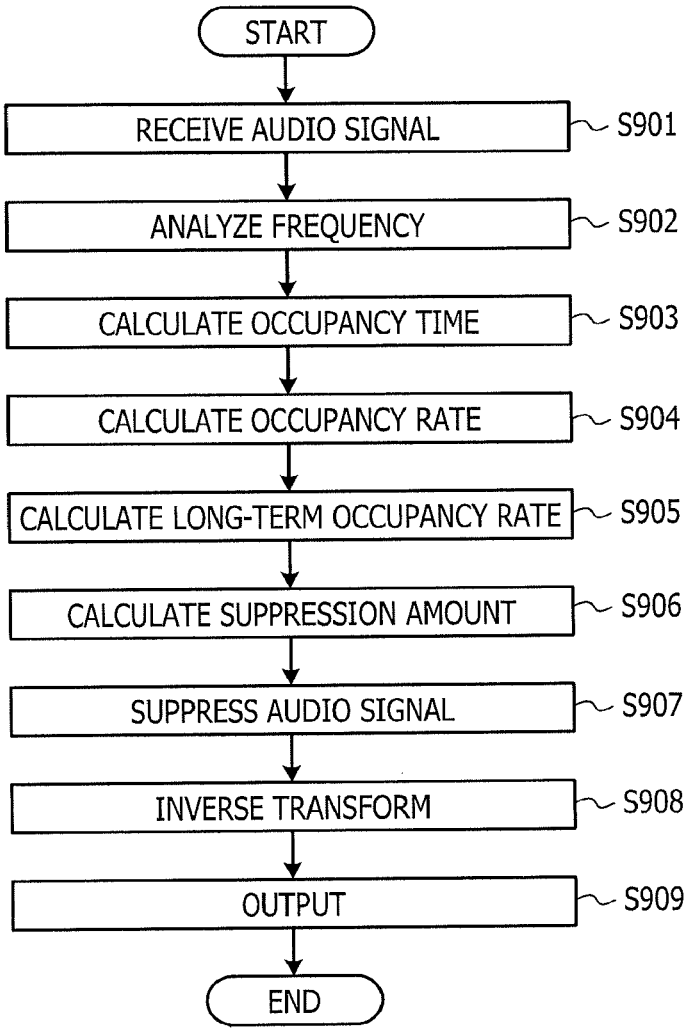
FIG. 9 is a diagram illustrating a processing flow of the audio processing device according to the fourth embodiment.

FIG. 9 is a diagram illustrating a processing flow of the audio processing device 100 according to the fourth embodiment. In the same manner as the first embodiment, also in the fourth embodiment, in a case where audio signals are received from N input devices (2≤N), processing to an audio signal xn(t) (1≤n≤N) input from an n-th input device will be described.

In the audio processing device 100 according to the fourth embodiment, after the input unit 801 receives input of the audio signal xn(t) (step S901), the frequency analysis unit 802 analyzes a frequency of the audio signal xn(t) which receives the input and calculates a frequency spectrum Xn(I, f) (step S902).

The audio processing device 100 calculates an occupancy time b'''n(I) in each of I frames of the audio signal xn(t) input by the occupancy time calculation unit 803*a* (step S903). An equation used when calculating the occupancy time in the I frame is represented by Equation 15. Assuming that a length of time of the I frame is TI (for example, 1024 ms), sizes of an audio signal at each of predetermined times (for example, every 1 ms) are compared. i-th audio signal compared in TI is xn(i).

$$b'''n(l) = \sum_{i=t-T1}^{t} F_l(i) \begin{cases} F_l(i) = 1 & (xn(i) = \mathrm{Max}xo(i)) \\ F_l(i) = 0 & (xn(i) \neq \mathrm{Max}xo(i)) \end{cases} \tag{15}$$

$$(t - Tl \leq i \leq t),\ (1 \leq o \leq N)$$

Based on a predetermined time T in the past and the occupancy time b'''n(I) calculated by the occupancy time calculation unit 803*a*, the audio processing device 100 calculates an occupancy rate sh'''n(I) of n-th audio (step S904). An equation used when calculating the occupancy rate sh'''n(I) is represented by Equation 16.

$$sh'''n(I)=b'''n(I)/TI \tag{16}$$

the long-term occupancy rate calculation unit 803*c* calculates a mode of the occupancy rate sh'''n(I) within a predetermined time T2 (T2≥T1) in the past as a long-term occupancy rate Ish'''n(I) (step S905). However, a calculation method of the long-term occupancy rate Ish'''n(I) is not limited to the mode, for example, a median value or an average value may be calculated as a long-term occupancy rate.

In the audio processing device 100, after the long-term occupancy rate Ish'''n(I) is calculated, the suppression amount calculation unit 803*d* calculates a suppression amount. Based on a fifth state determination threshold TH5, a sixth state determination threshold TH6 (TH5>TH6), the occupancy rate sh'''n(I), and a frequency spectrum X'n(I, f), the suppression amount calculation unit 803*d* calculates a suppression amount G'''n(I,f) (step S906). An equation used when calculating the suppression amount G'''n(I, f) is represented by Equation 17.

$$G''n(l, f) = \begin{cases} 1 & \left( \begin{array}{c} lshn(l) > TH3 \\ TH4 \leq lshn(l) \leq TH3 \text{ and} \\ X'n(l, f_{im}) = \mathrm{Max}X'o(l, f_{ip}) \end{array} \right) \\ 0 & \left( \begin{array}{c} TH4 \leq slhn(l) \leq TH3 \text{ and} \\ X'n(l, f_{im}) \neq \mathrm{Max}X'o(l, f_{ip}) \\ lshn(l) < TH4 \end{array} \right) \end{cases} \tag{17}$$

$$(1 \leq o \leq N),\ (1 \leq p \leq M)$$

The controller 804 of the audio processing device 100 performs suppression of a frequency spectrum and calculates an estimation spectrum S'''n(I, f) based on the suppression amount G'''n(I, f) calculated by the suppression amount calculation unit 803*d* (step S907). An equation used when calculating the estimation spectrum S'''n(I, f) is represented by Equation 18.

$$S'''n(I,f)=G'''n(I,f)\times Xn(I,f) \tag{18}$$

The converter 805 of the audio processing device 100 performs inverse transform to the estimation spectrum S'''n (I, f) calculated by the controller 804 and calculates an estimation audio signal s'''n(I, f) corresponding to an input spectrum (step s908), and the output unit 806 outputs the estimation audio signal s'''n(I, f) (step S909).

As described above, by performing suppression based on a long-term occupancy rate, even if a surrounding environment changes and an occupancy rate is changed, it is possible to analyze audio with high accuracy.

Figure 10:
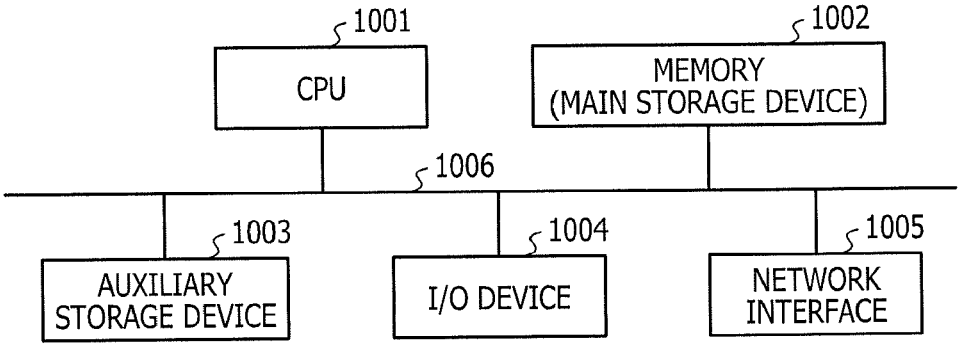
FIG. 10 is a diagram illustrating a hardware configuration example of the audio processing device.

Next, a hardware configuration example of the audio processing device 100 according to the first embodiment to the fourth embodiment will be described. FIG. 10 is a diagram illustrating the hardware configuration example of the audio processing device 100. As illustrated in FIG. 10, in the audio processing device 100, a central processing unit (CPU) 1001, a memory (main storage device) 1002, an auxiliary storage device 1003, an I/O device 1004, and a network interface 1005 are connected with each other via a bus 1006.

The CPU 1001 is an execution processing unit of controlling an overall operation of the audio processing device 100 and controls processing of each of functions such as the frequency analysis unit, the noise estimation unit, the calculation unit, and the like in the first embodiment to the fourth embodiment.

The memory 1002 is a storage unit for storing in advance a program such as an operating system (OS) for controlling an operation of the audio processing device 100 and for being used as a desired area when executing the program and is, for example, a random access memory (RAM), a read only memory (ROM), or the like.

The auxiliary storage device 1003 is a storage device such as a hard disk, a flash memory, or the like and is a device which stores various control programs executed by the CPU 1001, obtained data, and the like.

The I/O device 1004 receives an input of an audio signal from the input device, an instruction to the audio processing device 100 using an input device such as a mouse, a keyboard, or the like, an input of a value set by the user, and the like. In addition, a suppressed frequency spectrum or the like is output to an external audio output unit or a display image generated based on data stored in the storage unit is output to a display or the like.

The network interface 1005 is an interface device which manages exchanges of various types of data performed with an outside by wire or wireless.

The bus 1006 is a communication path which connects the devices described above and exchanges data.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio processing method, comprising:

generating a plurality of frequency spectra by transforming a plurality of audio signals, each audio signal of the plurality of audio signals being inputted to a corresponding input device of a plurality of input devices; and for each frequency spectrum of the plurality of frequency spectra:

determining target frequency components from among frequency components of the each frequency spectrum;

comparing an amplitude of each of the target frequency components of the frequency spectrum with an amplitude of each of other target frequency components of one or more other frequency spectra;

specifying one or more target frequency components whose amplitude is larger than amplitudes of the other target frequency components of the one or more other frequency spectra;

calculating a proportion of a first total number of the specified one or more target frequency components to a second total number of the target frequency components of the frequency spectrum; and controlling an output of the audio signal corresponding to the frequency spectrum based on a suppression amount, the suppression amount being calculated based on the proportion.

2. The audio processing method according to claim 1, wherein the determining the target frequency components includes:

estimating a noise spectrum included in the frequency spectrum; and determining the target frequency components whose amplitudes are to be compared in the comparing, based on amplitudes of each of frequency components of the frequency spectrum and the noise spectrum.

3. The audio processing method according to claim 2, wherein the output is controlled based on comparing the proportion with a threshold.

4. The audio processing method according to claim 3, the audio processing method further comprising:

for a target frequency component in which a difference between amplitudes of the target frequency components in the frequency spectrum and the noise spectrum is equal to or less than a predetermined value, decreasing the threshold when the proportion is less than a first value; and for the target frequency component, increasing the threshold when the proportion is larger than a second value.

5. The audio processing method according to claim 1, the audio processing method further comprising, for each frequency spectrum of the plurality of frequency spectra:

specifying a smoothed frequency spectrum obtained by smoothing, in a time direction, the frequency spectrum in a first period and the frequency spectrum in a second period continuous with the first period; and specifying the proportion based on a comparison of amplitudes of each of the frequency components of the smoothed frequency spectrum.

6. The audio processing method according to claim 5, wherein, when a difference is equal to or more than a predetermined value between an amplitude of the frequency spectrum in the first period and an amplitude of the frequency spectrum in the second period, the smoothing is performed with weighting the first period much than the second period.

7. The audio processing method according to claims 1, the audio processing method further comprising:

specifying a smoothed proportion obtained by smoothing, in a time direction, the proportion in a first period and the proportion in a second period continuous with the first period, wherein the output is controlled based on the smoothed proportion.

8. The audio processing method according to claim 7, wherein, when a difference is equal to or more than a predetermined value between the proportion in the first period and the proportion in the second period, the smoothing is performed with weighting the first period much than the second period.

9. An audio processing device, comprising:

a memory; and a processor coupled to the memory and the processor configured to:

generate a plurality of frequency spectra by transforming a plurality of audio signals, each audio signal of the plurality of audio signals being inputted to a corresponding input device of a plurality of input devices; and for each frequency spectrum of the plurality of frequency spectra:

determine target frequency components from among frequency components of the each frequency spectrum;

compare an amplitude of each of the target frequency components of the frequency spectrum with an amplitude of each of other target frequency components of one or more other frequency spectra;

specify one or more target frequency components whose amplitude is larger than amplitudes of the other target frequency components of the one or more other frequency spectra;

calculate a proportion of a first total number of the specified one or more target frequency components to a second total number of the target frequency components of the frequency spectrum; and control an output of the audio signal corresponding to the frequency spectrum based on a suppression amount, the suppression amount being calculated based on the proportion.

10. A non-transitory computer readable storage medium that stores a program that causes a computer to execute a process comprising:

generating a plurality of frequency spectra by transforming a plurality of audio signals, each audio signal of the plurality of audio signals being inputted to a corresponding input device of a plurality of input devices; and for each frequency spectrum of the plurality of frequency spectra:

determining target frequency components from among frequency components of the each frequency spectrum;

comparing an amplitude of each of the target frequency components of the frequency spectrum with an amplitude of each of other target frequency components of one or more other frequency spectra;

specifying one or more target frequency components whose amplitude is larger than amplitudes of the other target frequency components of the one or more other frequency spectra;

calculating a proportion of a first total number of the specified one or more target frequency components to a second total number of the target frequency components of the frequency spectrum; and controlling an output of the audio signal corresponding to the frequency spectrum based on a suppression amount, the suppression amount being calculated based on the proportion.

* * * * *